US006952890B1

(12) United States Patent
Blakeslee

(10) Patent No.: US 6,952,890 B1
(45) Date of Patent: Oct. 11, 2005

(54) LACE RETAINER FOR FOOTWEAR

(75) Inventor: Carl Andrew Blakeslee, Portland, OR (US)

(73) Assignee: Nike, Inc., Beaverton, OR (US)

( * ) Notice: Subject to any disclaimer, the term of this patent is extended or adjusted under 35 U.S.C. 154(b) by 47 days.

(21) Appl. No.: 10/652,309

(22) Filed: Sep. 2, 2003

(51) Int. Cl.[7] ..... A43C 7/00
(52) U.S. Cl. ..... 36/50.1; 24/712; 24/712.1
(58) Field of Search ..... 36/50.1, 54, 136, 36/50.5; 24/712, 712.1, 713.2, 714.6, 714.7, 24/715.6

(56) References Cited

U.S. PATENT DOCUMENTS

| | | | | | |
|---|---|---|---|---|---|
| 716,528 | A | * | 12/1902 | Flowers | 36/50.1 |
| 879,272 | A | * | 2/1908 | Key | 24/712.2 |
| 1,340,503 | A | * | 5/1920 | Schopper | 24/712.5 |
| 3,458,368 | A | | 7/1969 | Boging | |
| 3,526,977 | A | * | 9/1970 | Partagas | 36/50.1 |
| 3,548,798 | A | | 12/1970 | Adams | |
| 3,703,775 | A | | 11/1972 | Gattl | |
| 3,710,486 | A | * | 1/1973 | Revny | 36/50.1 |
| 3,934,346 | A | | 1/1976 | Sasaki et al. | |
| 4,200,998 | A | | 5/1980 | Adams | |
| 4,282,659 | A | | 8/1981 | Bourque et al. | |
| RE31,052 | E | * | 10/1982 | Adams | 36/50.1 |
| 4,442,613 | A | | 4/1984 | Dobbin | |
| 4,458,373 | A | | 7/1984 | Maslow | |
| 4,547,981 | A | | 10/1985 | Thais et al. | |
| 4,622,763 | A | | 11/1986 | Adams | |
| 4,942,678 | A | | 7/1990 | Gumbert | |
| 4,972,609 | A | | 11/1990 | Oh et al. | |
| 4,972,613 | A | | 11/1990 | Loveder | |
| 5,158,428 | A | | 10/1992 | Gessner et al. | |
| 5,291,671 | A | | 3/1994 | Caberlotto et al. | |
| 5,371,957 | A | | 12/1994 | Gaudio | |
| 5,511,325 | A | | 4/1996 | Hieblinger | |
| 5,657,557 | A | | 8/1997 | Hull et al. | |
| D385,043 | S | | 10/1997 | Worthington | |
| 5,678,325 | A | | 10/1997 | Davidowitz et al. | |
| 5,755,044 | A | | 5/1998 | Veylupek | |
| 5,884,419 | A | | 3/1999 | Davidowitz et al. | |
| 5,943,793 | A | | 8/1999 | Clements | |
| 6,088,936 | A | | 7/2000 | Bahl | |
| 6,192,559 | B1 | * | 2/2001 | Munsell, Jr. | 24/712.1 |
| 6,282,817 | B1 | * | 9/2001 | Curet | 36/50.1 |
| 6,286,233 | B1 | | 9/2001 | Gaither | |
| 6,338,186 | B1 | * | 1/2002 | Kleinmann | 24/712.2 |
| 6,370,743 | B2 | * | 4/2002 | Choe | 24/712 |
| 6,532,688 | B2 | * | 3/2003 | Bouvier | 36/50.1 |
| 6,823,610 | B1 | * | 11/2004 | Ashley | 36/54 |
| 2002/0002781 | A1 | * | 1/2002 | Bouvier | 36/50.1 |

* cited by examiner

*Primary Examiner*—M. D. Patterson
(74) *Attorney, Agent, or Firm*—Banner & Witcoff, Ltd.

(57) ABSTRACT

The invention is an article of footwear that includes a retainer for securing end portions of the laces and limiting superfluous lace movement. The retainer is a strip of elastic material that is positioned on an upper of the footwear and secured in first and second locations, thereby leaving an unsecured area between the first and second locations. The end portions of the lace may be placed under the unsecured area to restrain movement of the end portions. The retainer may be utilized with a mechanical fastener, rather than a conventional knot, to preserve the selected tension in the laces.

18 Claims, 5 Drawing Sheets

LACE RETAINER FOR FOOTWEAR

BACKGROUND OF THE INVENTION

1. Field of the Invention

The present invention relates to footwear. The invention concerns, more particularly, a retainer located on an article of footwear for limiting superfluous lace movement.

2. Description of Background Art

Conventional articles of athletic footwear generally include two primary elements, an upper and a sole structure attached to the upper. The upper securely and comfortably receives a foot, and the sole structure attenuates ground reaction forces and absorbs energy as the footwear contacts the ground. Depending upon the particular style of an article of footwear, various materials may be utilized in manufacturing the upper. The upper of athletic footwear, for example, is generally formed from multiple layers of foam, leather, and textile materials that are stitched and adhesively bonded together. Dress shoe uppers may be formed exclusively of leather elements that are stitched together. Similarly, uppers for hiking boots may include a cushioned interior formed of foam and textiles, and a leather exterior that provides a high degree of durability and wear-resistance.

The upper generally forms a void on the interior of the footwear for receiving the foot, with access to the void being provided by an ankle opening. A lacing system is often incorporated into the upper to selectively increase the size of the ankle opening when placing the footwear upon the foot or removing the footwear from the foot. In addition to increasing the size of the ankle opening, the lacing system may also permit the wearer to modify-the-certain dimensions of the upper, particularly girth, to accommodate feet with varying dimensions.

A conventional lacing system is depicted in U.S. Pat. No. 6,108,943 to Hudson et al. The upper includes a vamp area that defines a throat extending along an instep portion of the footwear. A plurality of apertures are formed adjacent to the throat, and a lace is threaded through the apertures and across the throat in a zigzag pattern such that ends of the lace extend from apertures located adjacent to the ankle opening. In addition, a tongue is positioned within the throat and under the laces to separate the laces from a foot received by the upper. Edges of the throat are pulled together by inducing tension in the laces, thereby decreasing the size of the upper and conforming the upper to the specific dimensions of the foot. The ends of the lace are then tied together in a manner that preserves a comfortable degree of tension in the laces.

Although a majority of footwear styles, particularly articles of athletic footwear, incorporate a conventional lacing system, many articles of footwear include modified lacing systems. For example, a dual lacing system may be utilized to provide separate adjustment for the vamp area adjacent the toes and the vamp area adjacent to the ankle opening, as disclosed in U.S. Pat. No. 3,546,796 to Adams; U.S. Pat. No. 3,934,346 to Sasaki et al.; U.S. Pat. No. 4,442,613 to Dobbin; and U.S. Pat. No. 4,622,763 to Adams. Lacing systems may also be modified to include a mechanical fastener for the lace, thereby obviating the need to tie the lace with a conventional knot, as disclosed in U.S. Pat. No. 4,458,373 to Maslow.

SUMMARY OF THE INVENTION

The present invention is an article of footwear having an upper for receiving a foot of a wearer and a sole structure attached to the upper. The upper includes a plurality of apertures, a lace, and a retainer. The apertures are positioned on a vamp portion of the upper, with the lace extending through the apertures. The retainer is secured to the upper in a first location and a second location, and the retainer is unattached to the upper between the first location and the second location to form an area for receiving portions of the lace. In operation, the wearer may tuck the lace under the retainer to limit superfluous movement of the lace. The retainer may be located on any portion of the upper, including a tongue of the upper. Suitable materials for the retainer include textiles, such as elastic materials.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1:
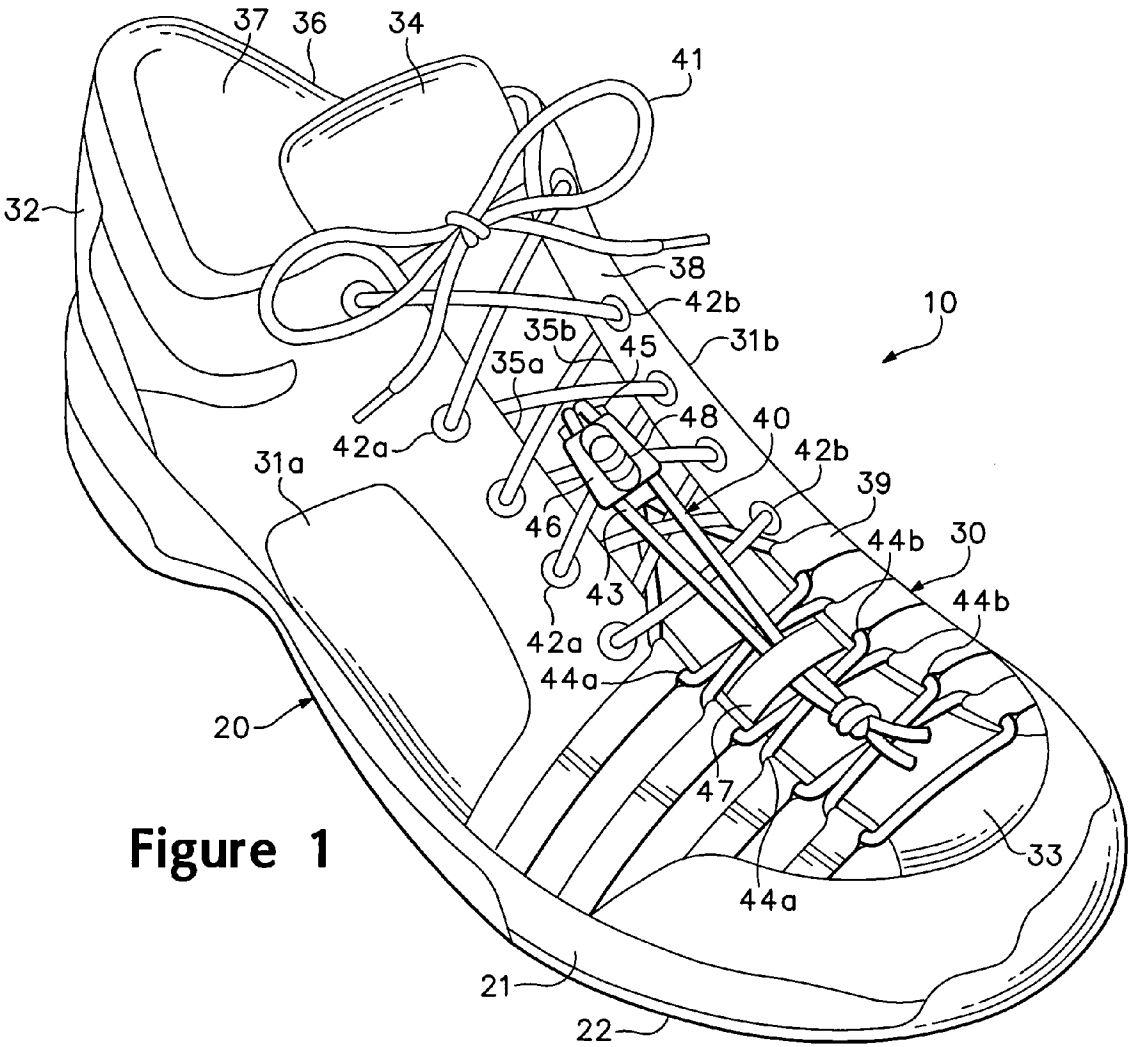
FIG. 1 is a perspective view of an article of footwear incorporating a lacing system in accordance with the present invention.

The following discussion and accompanying figures disclose an article of footwear having a lacing system in accordance with the present invention. The footwear is depicted and discussed as an all-terrain shoe that may be utilized for hiking, trail running, or traversing areas of land characterized by boulders, small cliffs, crevices, or other physical features requiring a moderate degree of rock climbing skill. Although the lacing system is well-suited for an all-terrain shoe, as will be discussed in the following material, the lacing system may be incorporated into a wide variety of other footwear types. Accordingly, the present invention is not limited to the specific configuration discussed relative to footwear 10, but may be applied to a wide range of other footwear styles.

Footwear 10 is depicted in FIGS. 1–5 and includes a sole structure 20, an upper 30, and a lacing system 40. Sole structure 20 may have conventional configuration, and is depicted as including a midsole 21 and an outsole 22. Midsole 21 is the primary shock attenuation and energy absorbing element of footwear 10, and may be formed of a polymer foam, such as ethylvinylacetate or polyurethane foam. Outsole 22 is attached to a lower surface of midsole 21 and provides the primary ground-contacting element of footwear 10. Accordingly, outsole 22 is formed of a durable, wear-resistant material such as carbon black rubber compound and may include texturing to enhance traction. Sole structure 21 may also include an insole (not depicted) that is located within upper 30 and adjacent to a sole of the foot to enhance the comfort of footwear 10.

Upper 30 is attached to sole structure 20 in a conventional manner and includes a plurality of leather, textile, foam, and rubber elements, for example, that are stitched and adhesively bonded together to form a hollow structure for comfortably and securely receiving the foot. The various materials forming upper 30 combine to provide a structure having a lateral area 31*a*, an opposite medial area 31*b*, a heel area 32, a toe area 33, and a tongue 34. In addition, upper 30 incorporates lacing system 40, which will be described in greater detail below.

Lateral area 31*a* forms a lateral side of upper 30 and is generally configured to contact and cover a lateral surface of the foot. A portion of lateral area 31*a* extends onto a vamp area of footwear 10 and overlaps tongue 34 to form a lateral edge 35*a*. Medial area 31*b* has a similar configuration that generally corresponds with a medial surface of the foot. A portion of medial area 31*b* also extends onto the vamp area and overlaps an opposite side of tongue 34 to form a medial edge 35*b*.

Figure 2:
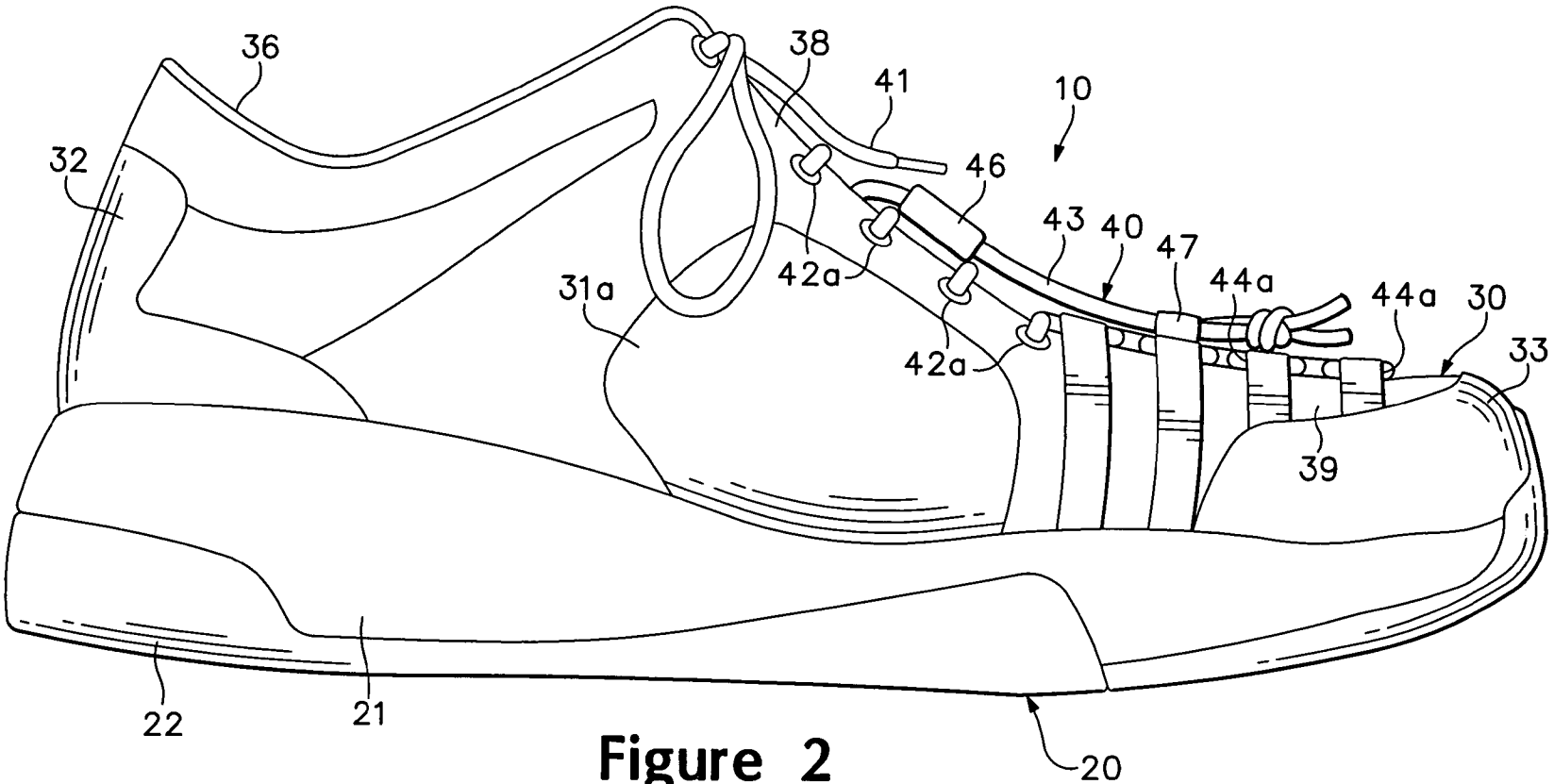
FIG. 2 is a lateral elevational view of the footwear.
Figure 3:
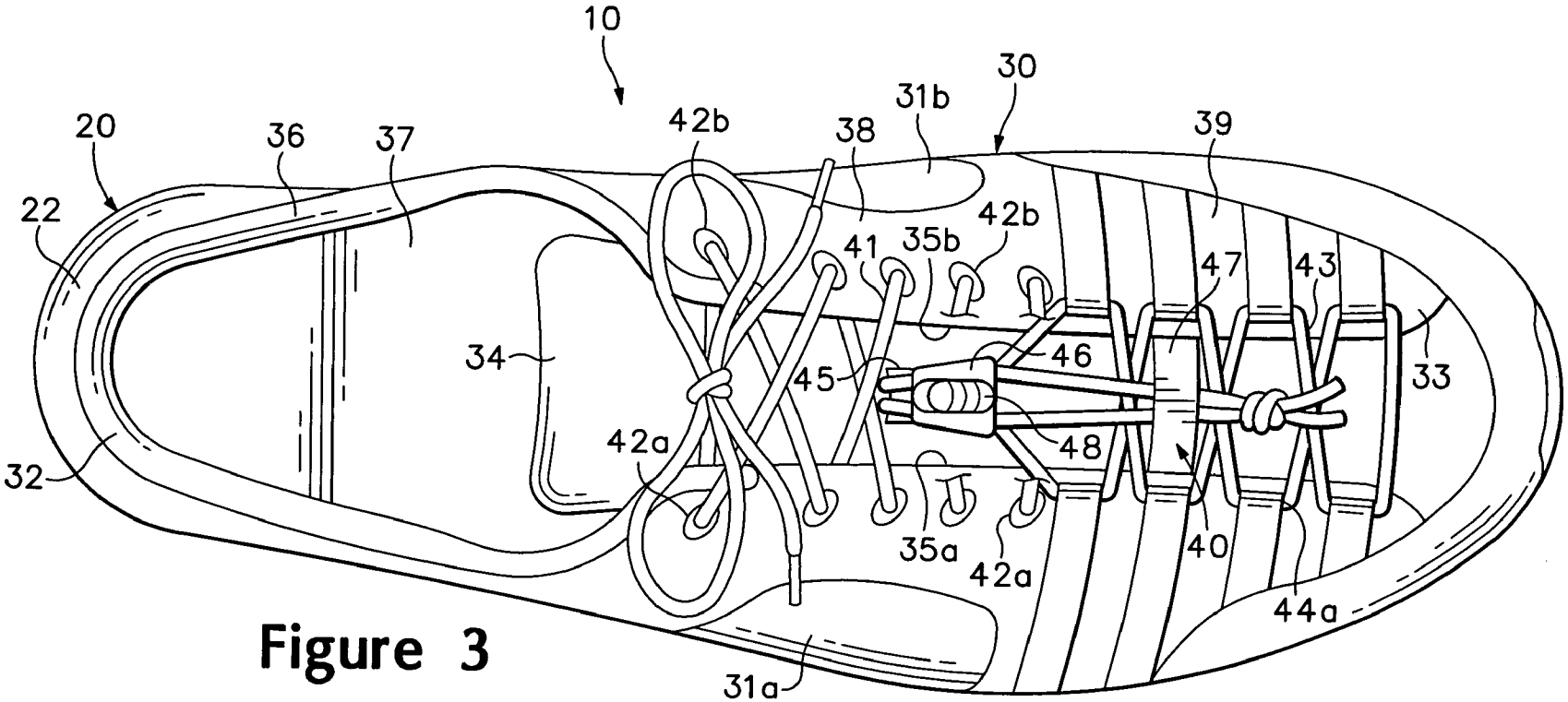
FIG. 3 is a first top plan view of the footwear that depicts laces in a tied configuration.
Figure 4:
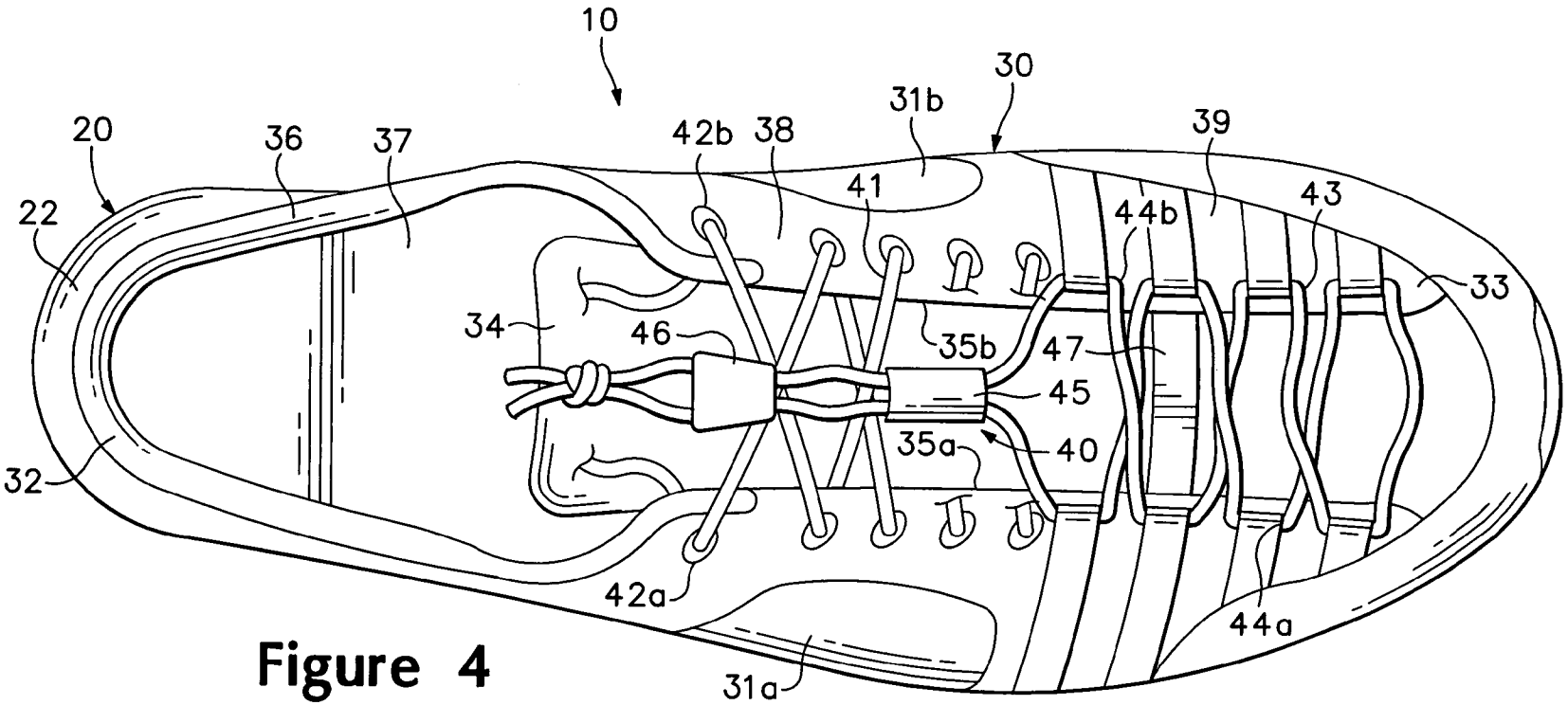
FIG. 4 is a second top plan view of the footwear that depicts the laces in an untied configuration.
Figure 5:
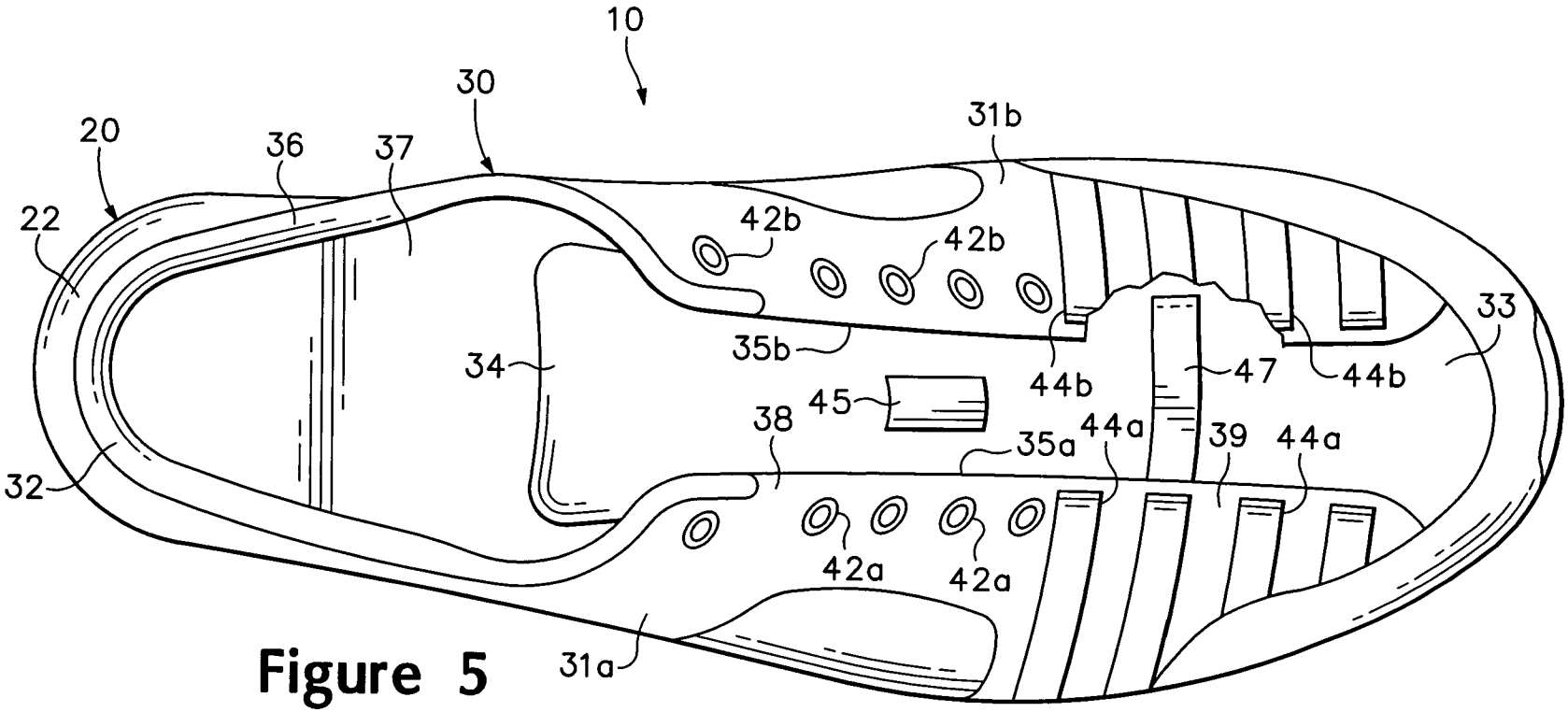
FIG. 5 is a third-top plan-view of the footwear, wherein the laces are removed.

The vamp area, which corresponds with the instep of the foot, is formed by lateral area 31*a*, medial area 31*b*, and tongue 34. More particularly, the vamp includes portions of lateral area 31*a* adjacent to lateral edge 35*a*, portions of medial area 31*b* adjacent to medial edge 35*b*, and the area therebetween. For purposes of the present invention, the vamp area may be divided into a first vamp portion 38 and a second vamp portion 39, as depicted in FIGS. 2 and 5. First vamp portion 38 forms an upper section of the vamp area and is positioned adjacent to heel area 32, and second vamp portion 39 forms a lower section of the vamp area and is positioned adjacent to toe area 33.

Heel area 32 is configured to extend around the heel of the foot and may include a heel counter formed of a semi-rigid polymer material, for example, to ensure that the heel remains properly positioned with respect to upper 30. The heel counter may be located on an exterior of heel area 32 or within the various material elements forming heel area 32. Lateral area 31*a* and medial area 31*b* are formed integral with heel area 32 to reduce the number of seams in upper 30, thereby enhancing the overall comfort and durability of footwear 10. Lateral edge 35*a* and medial edge 35*b* extend toward heel area 32 to define an upper edge 36 that forms an ankle opening 37 in heel area 32. Ankle opening 37 provides access to the void within upper 30.

Toe area 33 is configured to extend over a fore portion of the foot, including the toes, and may include wear-resistant elements to prevent excess abrasion as toe area 33 contacts concrete, rocks, trees, or other abrasive surfaces. Like heel area 32, toe area 33 is generally formed integral with lateral area 31*a* and medial area 31*b* to reduce the number of seams in upper 30.

Tongue 34 extends between lateral area 31*a* and medial area 31*b* and is generally positioned to correspond with the instep of the foot. As noted above, edges 35*a* and 35*b* overlap tongue 34. Accordingly, tongue 34 extends under portions of lateral area 31*a* and medial area 31*b* and separates both lacing system 40 and edges 35*a* and 35*b* from the foot. Side portions of tongue 34 are attached to an interior surface of lateral area 31*a* and medial area 31*b* in a conventional manner to permit lateral area 31*a* and medial area 31*b* to move relative to tongue 34 and each other.

Upper 30 expands and contracts in a lateral direction to accommodate feet with various dimensions, particularly the dimension of width. More particularly, lateral area 31*a* and medial area 31*b* move outward or inward relative to each other to provide the expansion and contraction of upper 30. Lacing system 40 is incorporated into upper 30 and utilized to retain the relative position of lateral area 31*a* and medial area 31*b*, thereby ensuring that footwear 10 remains configured for a specific width. In addition, lacing system 40 may be utilized to specifically configure footwear 10 for various types of activities.

Lacing system 40 includes a first lace 41, a plurality of first apertures 42*a* and 42*b*, a second lace 43, a plurality of second apertures 44*a* and 44*b*, a sleeve 45, a fastener 46, and a retainer 47. The structure of first lace 41 and second lace 43 may be similar to a conventional footwear lace formed of natural or synthetic materials that are either braided or woven together to form a generally elongate, rope-like structure. End portions of first lace 41 and second lace 43 may have a polymer coating that prevents fraying and easily extends through first apertures 42*a* and 42*b* and second apertures 44*a* and 44*b*, respectively. In addition, first lace 41 and second lace 43 may be a strip of a leather or polymer material.

First apertures 42*a* are located on first vamp portion 38 and adjacent to lateral edge 35*a*. Similarly, first apertures 42*b* are located on first vamp portion 38 and adjacent to medial edge 35*b*. First apertures 42*a* and 42*b* are formed from a grommet that extends through lateral area 31*a* and medial area 31*b*, respectively. Second apertures 44*a* are located on second vamp portion 39 and adjacent to lateral edge 35*a*. Similarly, second apertures 44*b* are located on second vamp portion 39 and adjacent to medial edge 35*b*. Unlike first apertures 42*a* and 42*b*, second apertures 44*a* and 44*b* are loops of material that are stitched to lateral area 31*a* and medial area 31*b*, respectively. In alternative embodiments, first apertures 42*a* and 42*b* may be loops of material, and second apertures 44*a* and 44*b* may be formed from grommets.

First lace 41 is threaded through first apertures 42*a* and 42*b* in a conventional zigzag lacing pattern. The end portions of first lace 41 are tied with a conventional bow-tie knot. Similarly, second lace 43 is threaded through second apertures 44*a* and 44*b*. The end portions of second lace 43 extending from second apertures 44*a* and 44*b* are then threaded through sleeve 45 and fastener 46, and the end portions may extend under retainer 47.

Sleeve 45 forms a tubular structure positioned longitudinally on an upper surface of tongue 34. As depicted in the figures, sleeve 45 is a generally planar element of material, and sides of the material are attached, through stitching for example, to tongue 34. This configuration forms a-tube between sleeve 45 and tongue 34 for receiving second lace 43. Alternately, sleeve 45 may be a tubular element of material or a metallic ring, for example, that forms a casing for receiving second lace 43. Suitable materials for sleeve 45 are either polymer sheets or the textile materials utilized to form upper 30 or second apertures 44*a* and 44*b*.

Fastener 46 is a mechanical fastener that includes two conduits for receiving the ends of second lace 43. A button 48 positioned on a top surface of fastener 46 may be moved rearward to permit second lace 43 to freely slide through the conduits in fastener 46. Button 48 may also be moved forward to prevent second lace 43 from sliding through the conduits, thereby selectively preventing second lace 43 from retreating through sleeve 45. The specific configuration of fastener 46 may vary within the scope of the present invention to include other mechanical fasteners, including the style disclosed in U.S. Pat. No. 4,458,373 to Maslow and U.S. Pat. No. 4,200,998 to Adams. In alternate embodiments of the present invention, fastener 46 may be absent from footwear 10 such that second lace 43 is secured with a conventional knot.

Lacing system 40 also includes a retainer 47 that is attached to tongue 43 in two locations and extends longitudinally across tongue 34. As depicted in the figures, retainer 47 is attached to tongue 34 in a first location, extends across a portion of tongue 34, and is also attached to tongue 34 in a second location, thereby forming an unattached area between retainer 47 and tongue 34. As with sleeve 45, retainer 47 may be a tubular element of material or a metallic ring, for example, that forms a casing for receiving end portions of second lace 43. Retainer 47 forms, therefore, a structure that extends over the end portions of second lace 43 to limit superfluous movement of second lace 43. In alternate embodiments, retainer 47 may extend in a longitudinal direction, a diagonal direction, or may be positioned on a different portion of tongue 34. In addition, retainer 47 may be positioned on other portions of upper 30, including lateral area 31*a*, medial area 31*b*, and toe area 33. Retainer 47 may also be attached to both lateral area 31*a* and medial area 31*b* so as to extend over tongue 34. Accordingly, the specific configuration and position of retainer 47 may vary significantly within the scope of the present invention.

As depicted in the figures, retainer 47 is a strip of material having a width of approximately one centimeter and a length of approximately six centimeters. The specific dimensions of retainer 47 may vary to have a width that ranges from one-fourth centimeter to three centimeters, and a length that ranges from one centimeter to ten centimeters, for example. A plurality of materials are suitable for retainer 47, including various textiles and elastic materials.

As discussed above, the concepts of the present invention may be applied to an all-terrain shoe, such as footwear 10, that is utilized for hiking, trail running, or traversing areas of land characterized by boulders, small cliffs or crevices, or other physical features requiring a moderate degree of rock climbing skill. In general, the types of activities that footwear 10 is intended to be used for may be classified as ambulatory activities or climbing activities. Whereas ambulatory activities include walking, hiking, jogging, and trail running, climbing activities include ascending small cliffs, traversing precipitous terrain, or scaling boulders, for example.

During ambulatory activities, individuals generally prefer that the portion of upper 30 corresponding with first vamp portion 38 contact the foot with sufficient force to limit movement of the foot relative to footwear 10. In addition, individuals prefer that the fore portion of the foot, which corresponds with second vamp portion 39, have sufficient room to flex and move naturally within upper 30. By drawing first lace 41 through first apertures 42*a* and 42*b* such that lateral area 31*a* and 31*b* are drawn into contact with the foot, the individual may select the specific tension in first lace 41 and configure footwear 10 for the particular width of the foot. The process of placing tension on first lace 41 permits the individual to judge the degree of contact between upper 30 and the foot. When the proper degree of contact is achieved, the individual may tie first lace 41 in a conventional manner. By only utilizing first lace 41 to tighten upper 30 around the foot, the portion of upper 30 corresponding with second vamp portion 39 remains in a relatively loose configuration, thereby permitting the desired flex and movement within upper 30.

Footwear intended for climbing activities, such as climbing shoes, fit tightly along the entire length of the foot to provide the individual with greater tactile perception of the cliff or ground that is in contact with the shoe. This configuration also prevents excess movement of the foot within the upper when ascending substantially vertical terrain. Accordingly, individuals also prefer that the portions of upper 30 corresponding with both first vamp portion 38 and second vamp portion 39 contact the foot with sufficient force to limit movement of the foot relative to footwear 10 during climbing activities. By also drawing second lace 43 through second apertures 44*a* and 44*b* such that a greater portion of lateral area 31*a* and medial area 31*b* are drawn into contact with the foot, the individual may configure footwear 10 for climbing activities. Once the proper tension is achieved in second lace 43, the individual configures fastener 46 to prevent second lace 43 from sliding relative to fastener 46, thereby tightening upper 30 around the fore portions of the foot and configuring footwear 10 for climbing activities.

The ends of second lace 43 extend through sleeve 45 and fastener 46. Mechanical fasteners, such as fastener 46, operate most efficiently if the laces are aligned so as to run in parallel immediately prior to entering the mechanical fastener. Sleeve 45 operates, therefore, to align the ends of second lace 43 prior to entering fastener 46, thereby enhancing the operation of fastener 46.

Depending upon the size of the foot and the degree of tension in second lace 43, the end portions of second lace 43 may be relatively long, thereby permitting the end portions to move relative to the remainder of footwear 10 during the ambulatory or climbing activities. In order to limit significant movement of the ends of second lace 43, the individual may position the ends under retainer 47. When formed of an elastic material, retainer 47 may be extended above tongue 34 to form a gap between retainer 47 and tongue 34. The ends of second lace 43 may then be positioned in the gap and retainer 47 may be released, thereby securing the ends under retainer 47 and limiting the movement of second lace 43.

A benefit to the configuration of lacing system 40, as described above, is that second lace 43 may be tensioned with a single hand of the individual. Whereas tying a knot in a lace generally requires both hands, the operation of fastener 46 may be achieved with a single hand. Within the scope of the present invention, however, sleeve 45 and fastener 46 may be absent such that a conventional knot is utilized with second lace 43. In this configuration, retainer 47 may still be utilized to limit movement of second lace 43. A retainer that is similar to retainer 47 may also be utilized in an article of footwear with a single lace.

The lacing system of the present invention is disclosed in the context of footwear 10, which includes a dual laces. A structure similar to retainer 47 may also be utilized in other articles of footwear that include a single lace. With reference to a conventional running shoe, for example, the laces may bounce, impact the shoe, or otherwise move during ambulatory activities. In order to limit movement of the laces, the loops formed by a conventional knot and the ends of the lace may be located under a retainer. Accordingly, a retainer structure that is similar to retainer 47 may be utilized on a variety of footwear types within the scope of the present invention.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of footwear that includes an upper and a sole structure attached to the upper, the upper comprising:

a lateral area extending along a lateral side of the footwear and into a vamp area of the footwear, the lateral area forming a lateral edge in the vamp area, and the lateral area including a plurality of apertures located adjacent the lateral edge;

a medial area extending along a medial side of the footwear and into the vamp area, the medial area forming a medial edge in the vamp area, and the medial area including a plurality of apertures located adjacent the medial edge;

a tongue positioned in the vamp area and extending under the lateral edge and the medial edge, the tongue being attached to an interior surface of the lateral area and an interior surface of the medial area;

a lace extending in a zigzag pattern through at least a portion of the apertures of the lateral area and the apertures of the medial area;

a sleeve that is secured to the tongue, the lace extending through the sleeve and into a mechanical fastener; and a retainer formed from a strip of an elastic material, the retainer being secured to the tongue in a first location and a second location, and the retainer being unattached to the tongue between the first location and the second location to form an area for receiving portions of the lace that extend from the mechanical fastener, the retainer being positioned closer to a toe area of the footwear than the sleeve.

2. The article of footwear of claim 1, wherein the retainer extends laterally across the tongue.

3. The article of footwear of claim 1, wherein the apertures are formed through the upper.

4. The article of footwear of claim 1, wherein the apertures are loops of material attached to the upper.

5. The article of footwear of claim 1, wherein the lace is secured with a mechanical fastener.

6. An article of footwear that includes an upper for receiving a foot of a wearer and a sole structure attached to the upper, the upper comprising:

a vamp portion defining a plurality of lace receiving areas;

a lace that extends through the lace receiving areas, the lace having an end area extending outward from the lace receiving areas;

a tongue extending under the lace;

a sleeve secured to the tongue, the lace extending through the sleeve and into a mechanical fastener;

a retainer formed from a strip of an elastic material, the retainer being separate from the sleeve and secure to the tongue in a first location and a second location, and the retainer being unattached to the tongue between the first location and the second location to form an area for receiving portions of the lace that extend from the mechanical fastener, the retainer being positioned closer to a toe area of the footwear than the sleeve.

7. The article of footwear of claim 6, wherein the lace receiving areas are apertures formed through the upper.

8. The article of footwear of claim 6, wherein the lace receiving areas are loops of material attached to the upper.

9. The article of footwear of claim 6, wherein the lace extends through a forefoot area of the footwear, and another lace extends though an area of the footwear that is adjacent an ankle opening of the upper.

10. A article of footwear that includes an upper for receiving a foot of a wearer and a sole structure attached to the upper, the upper comprising:

a first lace positioned adjacent an ankle opening of the upper;

a second lace extending through a forefoot area of the footwear;

a sleeve secured to the upper, end portions of the second lace extending through the sleeve;

a mechanical fastener for securing the end portions of the second lace that extend from the sleeve; and a retainer formed from an elastic material and secured to the upper, the retainer forming a structure for receiving the end portions of the second lace that extend from the mechanical fastener, and the retainer being positioned closer to a toe area of the footwear than the sleeve.

11. The article of footwear of claim 10, wherein the retainer is attached to the upper in a first location and a second location, and the retainer has an unattached area between the first location and the second location.

12. The article of footwear of claim 11, wherein the end portions of the lace extend through the unattached area.

13. The article of footwear of claim 10, wherein the retainer is attached to a tongue of the upper.

14. The article of footwear of claim 10, wherein the upper defines a plurality of apertures, the first lace extending trough a first portion of the apertures, and the second lace extending through a second portion of the apertures.

15. The article of footwear of claim 10, wherein the sleeve is an elongate, tubular structure.

16. An article of footwear that includes an upper for receiving a foot of a wearer and a sole structure attached to the upper, the upper comprising:

a vamp portion defining a plurality of lace receiving areas;

a pair of laces that extend through the lace receiving areas, each of the pair of laces having end areas extending outward from the lace receiving areas;

a tongue extending under the pair of laces;

a sleeve secured to the tongue, one of the pair of laces extending through the sleeve and into a mechanical fastener;

a retainer formed from an elastic material, the retainer being secured to the tongue in a first location and a second location, and the retainer being unattached to the tongue between the first location and the second location to form an area for receiving the one of the pair of laces extending through the sleeve and into the mechanical fastener, the retainer being positioned closer to a toe area of the footwear than the sleeve.

17. The article of footwear of claim 16, wherein the lace receiving areas are apertures formed through the upper.

18. The article of footwear of claim 16, wherein the lace receiving areas are loops of material attached to the upper.

* * * * *